US010206502B2

(12) United States Patent
Nye et al.

(10) Patent No.: US 10,206,502 B2
(45) Date of Patent: Feb. 19, 2019

(54) WALL MOUNTING SYSTEM

(71) Applicants: Cole Nye, Vanlue, OH (US); Nickolas Reinhart, Findlay, OH (US)

(72) Inventors: Cole Nye, Vanlue, OH (US); Nickolas Reinhart, Findlay, OH (US)

( * ) Notice: Subject to any disclaimer, the term of this patent is extended or adjusted under 35 U.S.C. 154(b) by 0 days.

(21) Appl. No.: 15/794,311

(22) Filed: Oct. 26, 2017

(65) Prior Publication Data

US 2018/0110332 A1 Apr. 26, 2018

Related U.S. Application Data

(60) Provisional application No. 62/413,046, filed on Oct. 26, 2016.

(51) Int. Cl.

| | |
|---|---|
| ***A47F 5/08*** | (2006.01) |
| ***A47B 57/58*** | (2006.01) |
| ***A47B 65/00*** | (2006.01) |
| ***A47B 81/00*** | (2006.01) |
| ***A47B 96/14*** | (2006.01) |

(52) U.S. Cl.

CPC ..... *A47B 81/005* (2013.01); *A47B 57/583* (2013.01); *A47B 57/585* (2013.01); *A47B 65/10* (2014.12); *A47B 65/15* (2014.12); *A47B 96/145* (2013.01); *A47F 5/0846* (2013.01); *A47B 2096/1491* (2013.01)

(58) Field of Classification Search

CPC ..... A47B 81/05; A47B 61/02; A47B 96/14; A47B 96/145; A47B 96/1466; A47B 2096/1491; A47B 65/10; A47B 57/58; A47B 57/583; A47B 57/585; A47B 57/588; A47B 65/15; A47B 65/20; A47F 5/0846; A47F 5/0838; A47F 5/0853; F16M 13/02; F16M 13/022

USPC ..... 211/43, 64, 87.01, 175, 90.02, 94.01, 211/184; 248/219.1, 220.21, 223.41, 248/228.1, 228.5, 228.3, 231.41, 231.61, 248/231.85, 241, 244, 257, 398.1, 316.8

See application file for complete search history.

(56) References Cited

U.S. PATENT DOCUMENTS 113,830 A * 4/1871 Anderson ..... B62B 5/0083 280/47.32
527,897 A * 10/1894 Stikeman ..... A47B 65/00 211/43
583,494 A * 6/1897 Lundberg ..... A47B 65/00 211/43

(Continued)

*Primary Examiner* — Jennifer E. Novosad
(74) *Attorney, Agent, or Firm* — Jacob M. Ward; Ward Law Office LLC

(57) ABSTRACT

A wall mounting system includes an elongate main body, a first holder, and a second holder. The main body has a channel. The channel is disposed along a length of the main body. The main body is configured for attachment to a wall surface. The first holder has at least one insert portion coupled thereto with a fastener. The insert portion of the first holder is selectively slidably received in the channel of the main body. The second holder is coupled to the main body. The fastener of the first holder is adjustable to selectively affix the first holder along the length of the main body. The first holder is selectively movable along the length of the main body relative to the second holder. The first holder and the second holder are configured to together selectively secure a hunting or fishing accessory to the main body.

14 Claims, 10 Drawing Sheets

(56) References Cited

U.S. PATENT DOCUMENTS 1,780,872 A * 11/1930 Dumben ..... A47B 65/00 108/28
2,206,133 A * 7/1940 Stoll ..... A47B 65/00 211/43
3,318,454 A * 5/1967 Donlin ..... A47B 57/585 211/43
3,414,221 A * 12/1968 Nelson ..... F41G 11/001 248/316.5
3,487,945 A * 1/1970 Barham ..... A47B 65/00 211/184
3,836,058 A * 9/1974 Penniman ..... B60R 9/12 211/70.5
3,917,071 A * 11/1975 Walters ..... A47B 81/005 211/4
4,113,108 A * 9/1978 Anderson ..... A47B 57/585 108/28
4,635,801 A * 1/1987 Oren ..... B25H 3/04 211/70.6
D310,446 S * 9/1990 Elkins ..... 211/64
4,991,723 A * 2/1991 Elkins ..... A47B 81/005 211/106.01
5,205,420 A * 4/1993 Petryszak ..... A47B 65/00 211/184
5,325,792 A * 7/1994 Mulloy ..... A47B 65/00 108/28
5,350,094 A * 9/1994 Morford ..... B60R 7/14 211/64
5,474,190 A * 12/1995 Won-Kim ..... A47B 57/588 211/184
5,487,518 A * 1/1996 McCraney ..... F24H 9/06 248/225.11
5,520,292 A * 5/1996 Lombardi ..... A47F 7/00 211/182
5,740,926 A * 4/1998 Mulloy ..... A47B 57/585 108/28
5,765,697 A * 6/1998 Soong ..... A47F 1/126 211/11
5,921,402 A * 7/1999 Magenheimer ..... H02G 3/26 211/26
5,960,967 A * 10/1999 Neil ..... A47F 5/0846 211/94.01
6,227,387 B1 * 5/2001 Rose ..... A47J 47/16 211/113
6,438,885 B1 * 8/2002 Murray ..... F41A 17/54 211/64
6,564,949 B1 * 5/2003 Saathoff ..... B25H 3/006 211/70.6
6,591,996 B1 * 7/2003 Wu ..... A47B 57/26 211/103
6,637,707 B1 * 10/2003 Gates ..... A47B 81/005 211/64
6,648,150 B2 * 11/2003 Hartstone ..... G11B 33/0461 211/11
6,935,065 B1 * 8/2005 Oliver ..... F41A 23/04 211/64
6,974,041 B2 * 12/2005 Salemi ..... A47B 57/585 211/184
8,727,294 B1 * 5/2014 Harms ..... F41A 23/18 206/317
8,950,596 B2 * 2/2015 Arabian ..... B60R 7/14 211/64
9,603,449 B1 * 3/2017 Evans ..... A47B 81/005
9,884,593 B2 * 2/2018 Hull ..... B60R 7/14
2002/0144962 A1 * 10/2002 Dettorre ..... A47F 5/0838 211/85.7
2003/0080079 A1 * 5/2003 Wu ..... F16B 2/16 211/89.01
2006/0175274 A1 * 8/2006 Yang ..... A47B 57/00 211/94.01
2009/0159540 A1 * 6/2009 Meeks ..... B60R 7/14 211/64
2011/0011812 A1 * 1/2011 Johnson ..... A47F 5/0838 211/1
2012/0037579 A1 * 2/2012 Muldoon ..... A01K 97/08 211/64
2014/0077432 A1 * 3/2014 Lee ..... B25B 5/003 269/75
2014/0312191 A1 * 10/2014 Reed ..... B63H 16/04 248/316.8
2015/0182020 A1 * 7/2015 Rahman ..... B60R 7/14 211/64
2018/0110332 A1 * 4/2018 Nye ..... A47B 81/005

* cited by examiner

WALL MOUNTING SYSTEM

CROSS-REFERENCE TO RELATED APPLICATIONS

This application claims the benefit of U.S. Provisional Application No. 62/413,046, filed on Oct. 26, 2016. The entire disclosure of the above application is hereby incorporated herein by reference.

FIELD

The disclosure generally relates to a wall mounting system and, in particular, a system for holding and mounting hunting or fishing accessories on a wall.

BACKGROUND

Proper storage of hunting and fishing accessories such as firearms, archery bows, and fishing rods is important for the maintenance and longevity of these accessories. The mounting of these accessories onto walls is sometimes performed, both to keep the accessories from a floor surface where they can be accidentally stepped upon and damaged, and to proudly display and enjoy the accessories while not in use. Maintaining such accessories, especially firearms, at a height out of the normal reach of children is also sometimes done for safety reasons.

Conventional systems for mounting hunting and fishing accessories have involved shelving or hooks installed on wall surfaces. However, these known systems are undesirable, as they do not readily accommodate accessories of different sizes and shapes, which can lead to the accessories falling from the shelving.

There is a continuing need for a wall mounting system that allows hunting and fishing enthusiasts to conveniently and safely store accessories such as firearms, archery bows, and fishing rods. Desirably, the wall mounting system is easy to use, and permits for an ornamental display of the hunting or fishing accessory.

SUMMARY

In concordance with the instant disclosure, a wall mounting system that allows hunting and fishing enthusiasts to conveniently store accessories such as firearms, archery bows, and fishing rods, which is easy to use, and which also permits for an ornamental display of the hunting or fishing accessory, has surprisingly been discovered.

In one embodiment, a wall mounting system includes an elongate main body, a first holder, and a second holder. The elongate main body has a channel formed therein along a length thereof. The elongate main body is configured for attachment to a wall surface. The first holder has at least one insert portion coupled thereto, typically with a threaded fastener. The insert portion of the first holder is selectively and slidably received in the channel of the elongate main body. The second holder is also coupled to the elongate main body. The fastener of the first holder is adjustable to selectively affix the first holder along the length of the elongate main body. Upon a loosening of the fastener, the first holder is movable along the length of the elongate main body relative to the second holder. Upon a tightening of the fastener, the first holder is affixed in place along the length of the elongate main body. The first holder and the second holder are configured to together selectively secure a hunting or fishing accessory.

In another embodiment, the second holder also has at least one insert portion coupled thereto with a fastener. The insert portion of the second holder is also selectively and slidably received in the channel of the elongate main body. In this manner, each of the first holder and the second holder may be advanced toward or away from the other in order to together secure different hunting or fishing accessories.

In a further embodiment, the first holder may have an aperture to receive the barrel of a gun, and the second holder may have a platform with a recess to support a stock of the gun.

In an additional embodiment, the first holder may have a channel configured to receive a bow string, and the second holder may have a first recess and second recess configured to support the base of a bow. The channel of the first holder may also possess a pair of bearings that are supported by springs. The two bearings are configured to abut each other, creating a clamp that secures the bow string in the channel.

Advantageously, the wall mounting system of the present disclosure is configured to secure and mount a hunting or fishing accessory such as a firearm, an archery bow, and a fishing rod of a multitude of different lengths and sizes.

DRAWINGS

The above, as well as other advantages of the present disclosure, will become readily apparent to those skilled in the art from the following detailed description, particularly when considered in the light of the drawings described hereafter.

Figure 8:
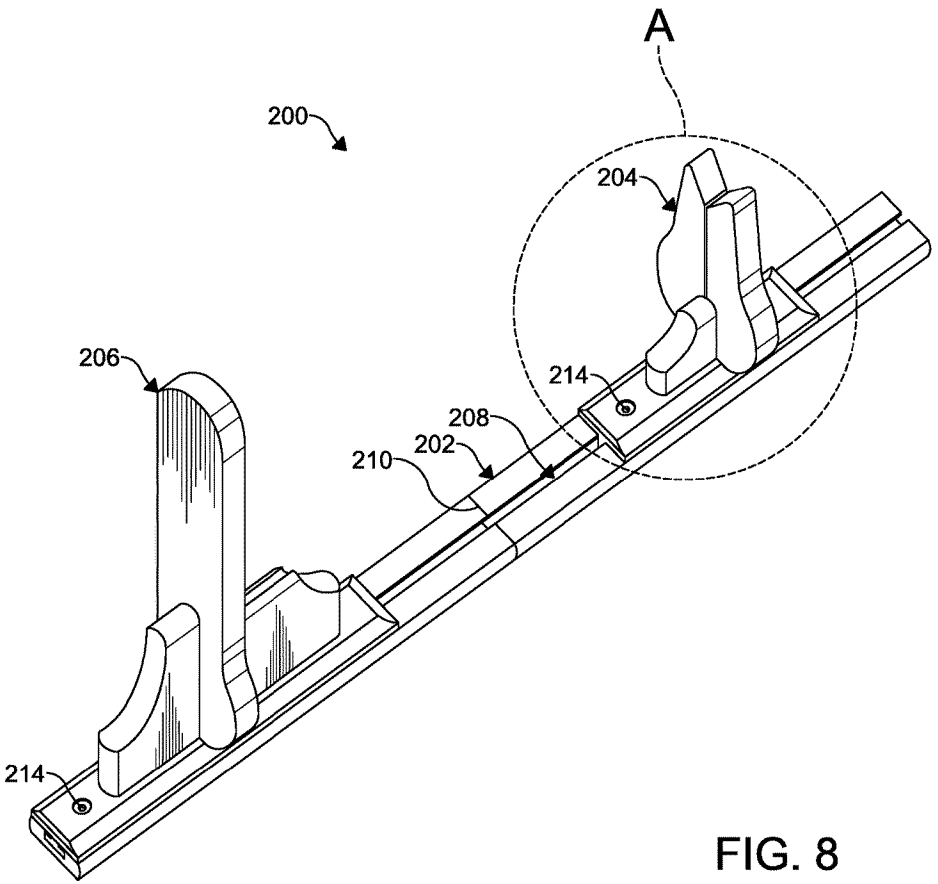
FIG. 8 is a right side perspective view of a wall mounting system according to another embodiment of the disclosure, the wall mounting system configured to hold a bow such as a compound bow or a long bow in a substantially upright position on a wall surface.
Figure 11:
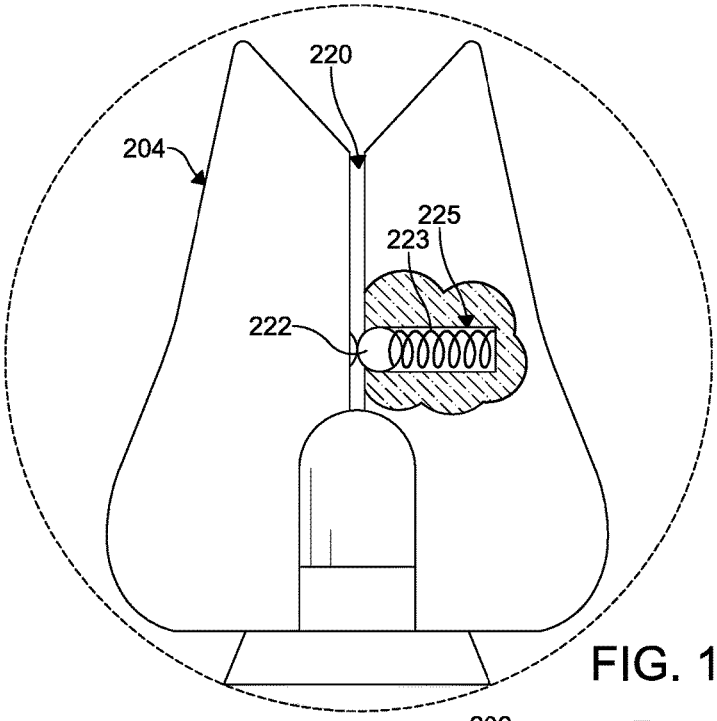
Figure 12:
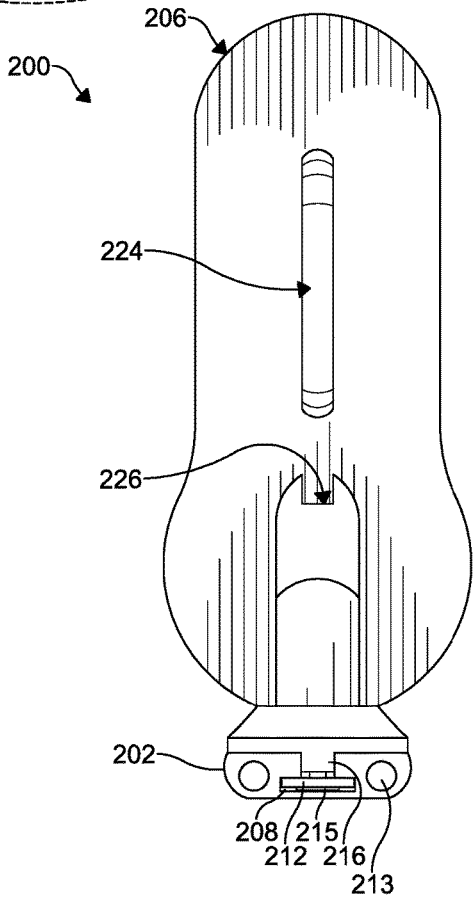

FIG. 11 is an enlarged fragmentary bottom plan view of the first holder at callout A in FIG. 8, further showing a pair of spring-loaded bearings disposed on opposing sides of the bow slot, and further having a cross-sectional view showing one of the spring-loaded bearings disposed in the interior of the first holder; and FIG. 12 is a top plan view of the second holder, illustrating two recesses that are configured to support the base of the bow.

DETAILED DESCRIPTION

The following description is merely exemplary in nature and is not intended to limit the present disclosure, application, or uses. It should also be understood that throughout the drawings, corresponding reference numerals indicate like or corresponding parts and features. In respect of the methods disclosed, the order of the steps presented is exemplary in nature, and thus, is not necessary or critical unless otherwise disclosed.

Referring to FIGS. 1-12, a wall mounting system 100, 200 according to the present disclosure is shown. In FIGS. 1-7, a first embodiment of the wall mounting system 100 is illustrated, where the wall mounting system 100 is configured to selectively secure a hunting accessory such as a shotgun (not shown) or a rifle (not shown) in a substantially upright position when mounted vertically on a wall surface. In FIGS. 8-12, a second embodiment of the wall mounting system 200 is illustrated, where the wall mounting system is configured to selectively secure a hunting accessory such as a bow (not shown) in a substantially upright position when vertically mounted on the wall surface. It should be understood that other suitable orientations when attaching the wall mounting system 100, 200, for example, a horizontal orientation, may also be employed as desired.

Additionally, one of ordinary skill in the art should understand that any suitable material may be used in the manufacturing of the wall mounting system 100, 200 of the disclosure. In an exemplary embodiment, the wall mounting system 100, 200 may be formed from a thermoplastic material, for example, by an injection molding process. As non-limiting examples, the thermoplastic material may include polypropylene or polyethylene. Other suitable materials and methods of manufacture may also be selected by the skilled artisan, as desired.

With respect to the first embodiment of FIGS. 1-7, the wall mounting system 100 includes an elongate main body 102, a first holder 104, and a second holder 106. The elongate main body 102 has a channel 108 formed therein. The channel 108 is oriented along a length of the elongate main body 102.

Figure 5:
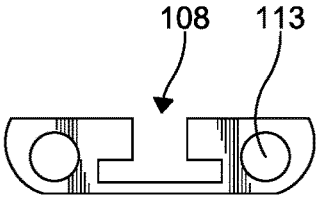
FIG. 5 is an enlarged end elevational view of the second main body portion shown in FIG. 3, illustrating a channel and two female connectors for cooperation with the male connectors shown in FIG. 4.

In a particular embodiment, shown in FIG. 5, the channel 108 has a T-shaped cross-section. This particular shape is especially configured for a selective affixing of the first holder 104 and the second holder 106 to the elongate main body 102, as will be described further herein. However, other suitable cross-sectional shapes for the channel 108 are contemplated, and may also be selected by the skilled artisan within the scope of the present disclosure.

The elongate main body 102 of the present disclosure is configured to be removably or permanently attached to a wall surface, for example, with bolts, nails, screws, or the like. For example, holes may be formed in a base of the channel 108 in order to permit the attaching of the elongate to the main body 102 by one of these means. Other suitable means for affixing the elongate main body 102 to the wall surface are also contemplate and may be used, as desired.

Figure 3:
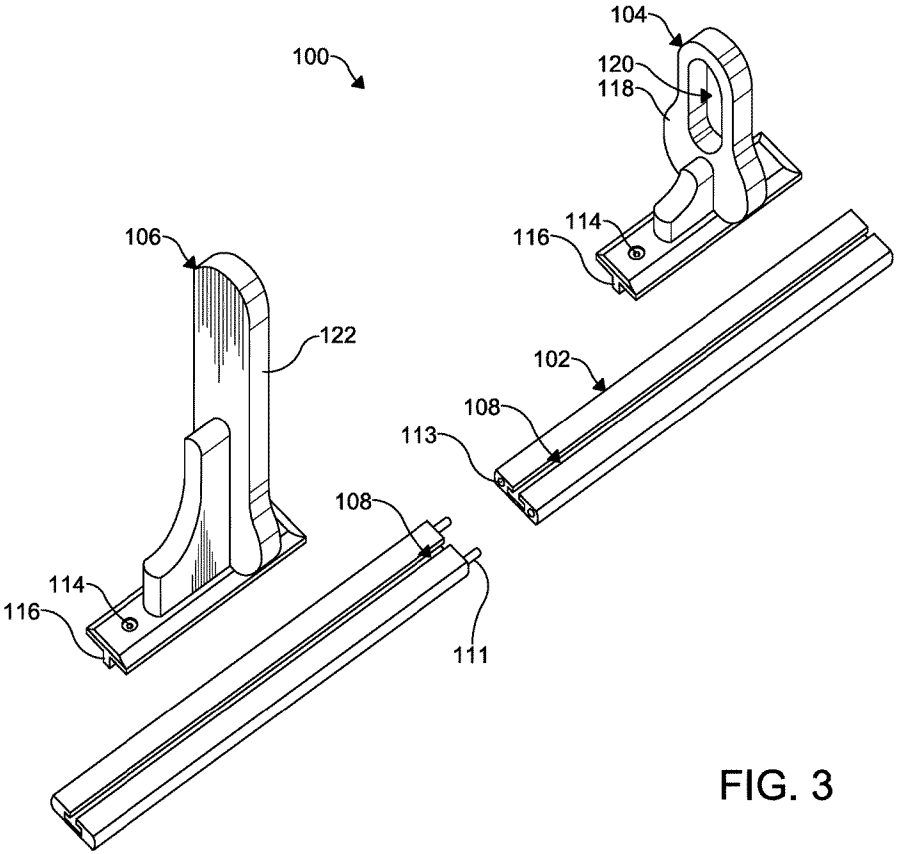
FIG. 3 is an exploded perspective view of a wall mounting system shown in FIG. 1, and further showing the elongate main body separated into a first main body portion and a second main body portion, and the elongate main body separated from a first holder and the second holder.
Figure 4:
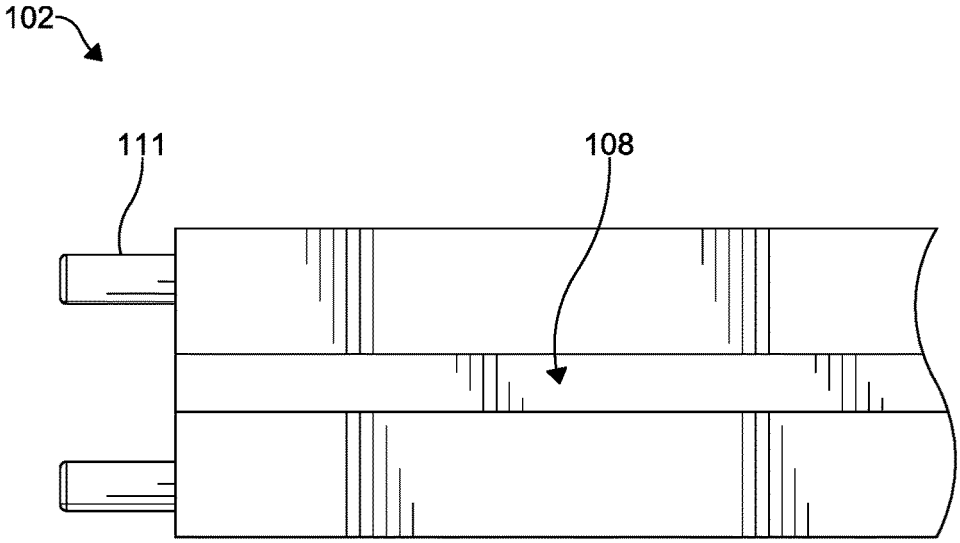
FIG. 4 is an enlarged fragmentary top plan view of the first main body portion shown in FIG. 3, illustrating two male connectors.

Referring now to FIG. 3, the elongate main body 102 may be provided as a multi-piece assembly, which a skilled artisan will appreciate has certain advantages for both manufacturing and shipping. For example, the elongate main body 102 may be separately formed as a first main body portion and a second main body portion, which are then coupled at a junction 110 upon assembly and for end use. As shown in FIGS. 3-5, the junction 110 may involve a cooperation of male connectors 111 of the first main body portion, such as posts, with female connectors 113 of the second main body portion, such as holes, for example, by a friction- or press-fit. Although two pieces are shown, it should be understood that more than two pieces may also be provided and assembled to form the elongate main body 102. One of ordinary skill may also select other suitable means for affixing the first main body portion with the second main body portion at the junction 110, in order to assemble the elongate main body 102, within the scope of the disclosure.

Figure 6:
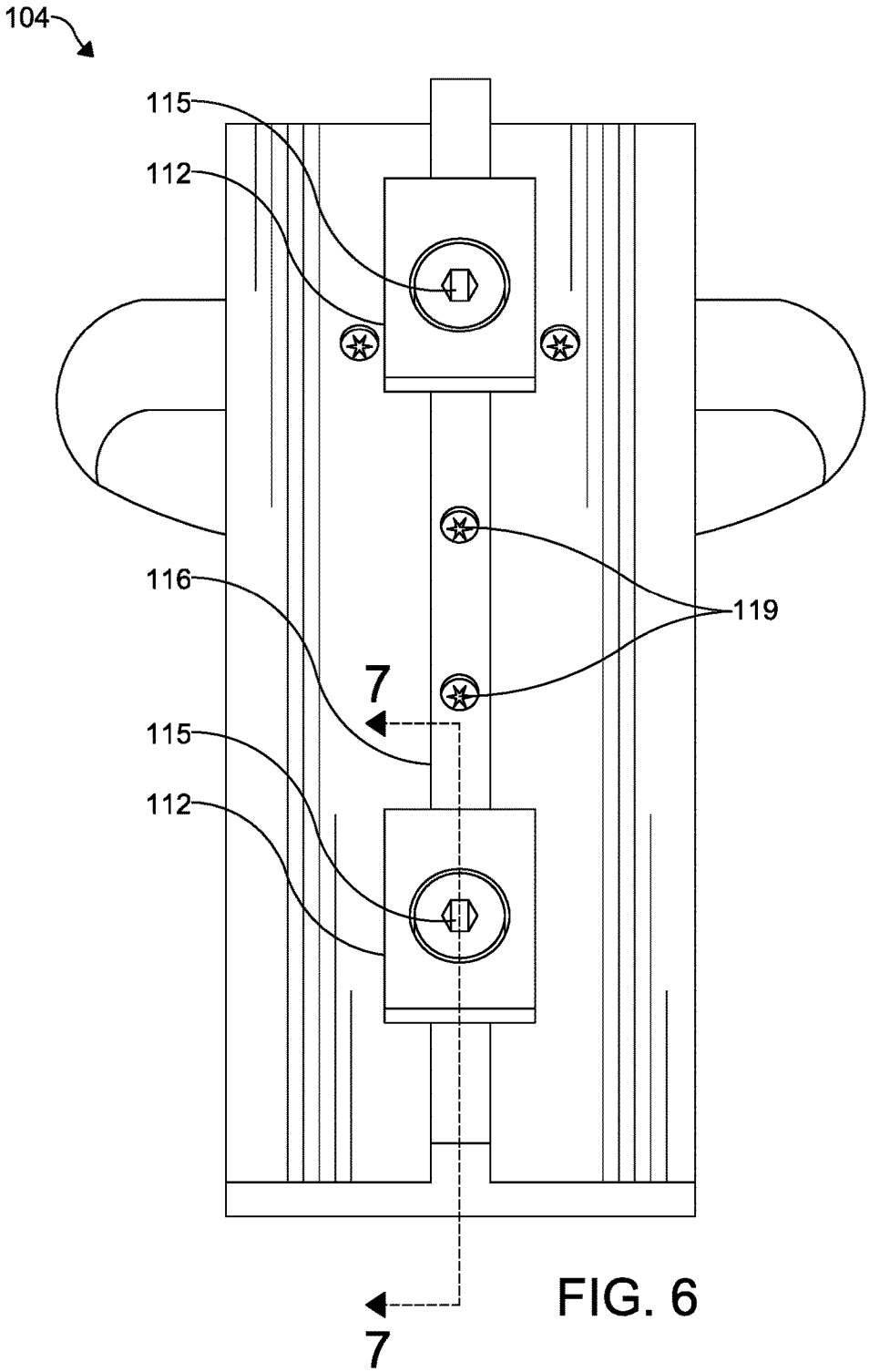
FIG. 6 is a bottom perspective view of the first holder shown in FIG. 3, and further showing the insert portions adjustably coupled to a bottom of the first holder with fasteners, the insert portions arranged along a rib formed on the bottom surface of the first holder.
Figure 7:
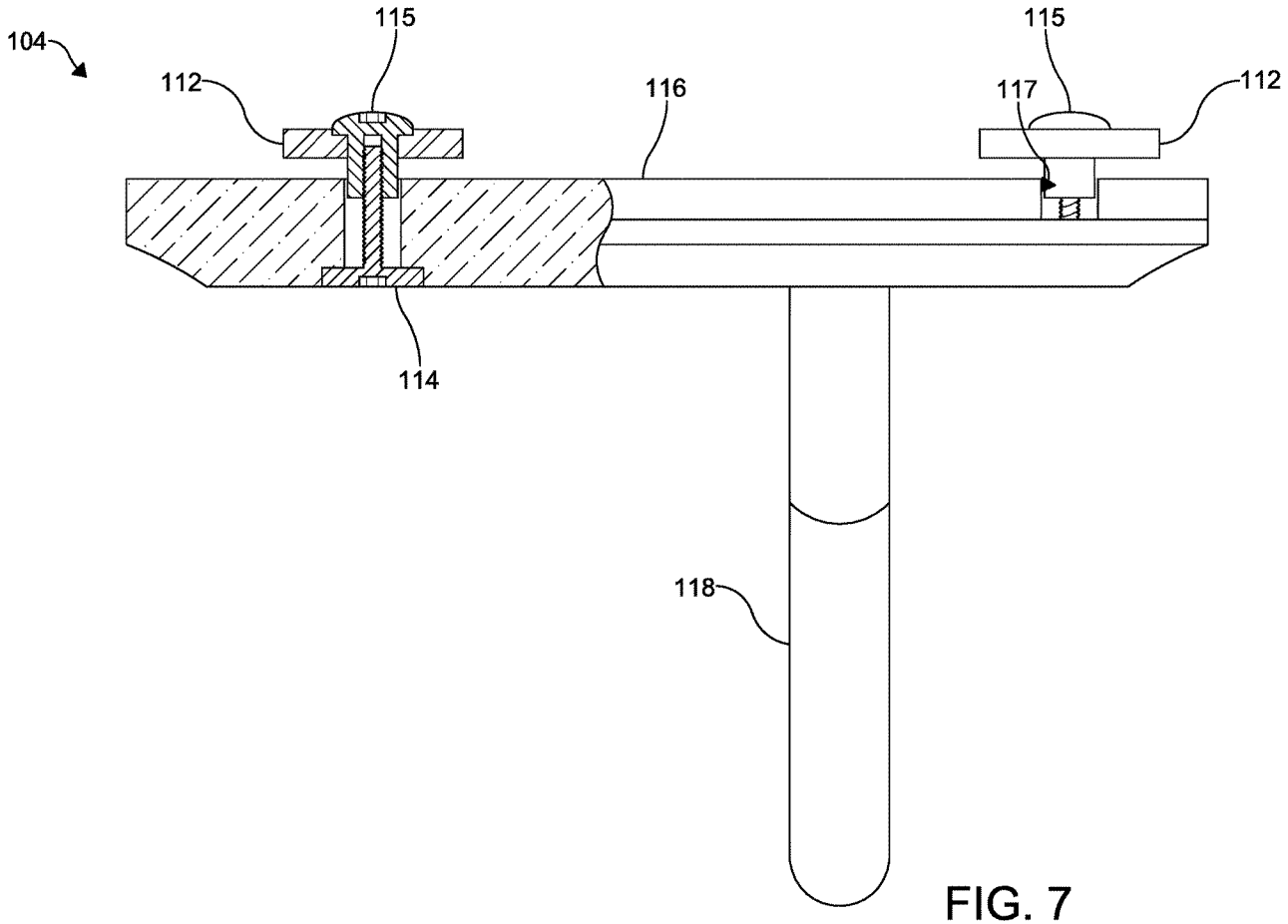
FIG. 7 is fragmentary cross-sectional side elevational view of the first holder shown in FIG. 6, and taken along section line 7-7, and further showing the insert portions adjustably coupled to the bottom of the first holder with threaded fasteners, and the fasteners and insert portions disposed through a gap formed in the ridge.

With reference to FIGS. 6-7, the first holder 104 has at least one insert portion 115 coupled thereto with a fastener 114. In a particular embodiment, shown in FIGS. 6-7, the first holder 104 has a pair of insert portions 115. Each of the insert portions 115 is coupled to the first holder with one of a pair of the fasteners 114. It should be appreciated that, upon assembly with the elongate main body 102, the at least one insert portion 115 of the first holder 104 is selectively and slidably received in the channel 108 of the elongate main body 102, as described further herein.

In certain embodiments, the insert portion 115 has a flat plate 112 that is shaped to be received in the top portion of the T-shaped cross-section of the channel 108. As shown in FIG. 7, the fastener 114 may include a stud with threads and be disposed through a hole in the first holder 104. For example, the fastener 114 may be attached to the insert portion 115 using an internally threaded grommet, which cooperates with the outer threaded stud of the fastener 114 that is disposed through the hole in the first holder 104.

In operation, when the fastener 114 is rotated, the fastener 114 will cause the insert portion 115 to advance toward (when tightened) or away from (when loosened) a bottom of the first holder 104. In this manner, the first holder 104 may be selectively secured in placed along the length of the elongate member 102, by an impinging and sandwiching of an inner surface of the channel 108 of the elongate member 102 between the insert portion 115 and the first holder 104 when the fastener 114 is tightened to a sufficient degree. Other suitable shapes of the insert portion 115, and means for causing the insert portion 115 to selectively impinge the inner surface of the channel 108 of the elongate member 102, may be selected as desired.

As shown in FIGS. 3 and 6-7, the first holder 104 may also have a rib 116 arranged on the bottom of the first holder 104. The rib 116 may also be oriented along a length the first holder 104. In particular, the rib 116 may be configured to align the first holder 104 in the channel 108 of the elongate body 102. Thus, the rib 116 may serve to guide the first holder 104 as it is selectively advanced along the length of the elongate body 102, in order to accommodate hunting or fishing accessories of different sizes. In certain embodiments, the rib may also have a gap 117 to accommodate the fastener 114 and insert portion 115.

With reference to FIG. 3, the first holder 104 may also have a holding portion 118. The holding portion 118 may be attached to the rest of the first holder 104 with additional fasteners 119, for example, or may formed integrally with the remainder of the first holder 104, as desired. The holding portion 118 may have a recess or an aperture 120 for receiving at least a portion of a hunting or fishing accessory therein. In certain embodiments, the aperture 120 is configured to receive the barrel of a rifle. However, the aperture 120 may be sized appropriately to hold a variety of different types of accessories.

Figure 1:
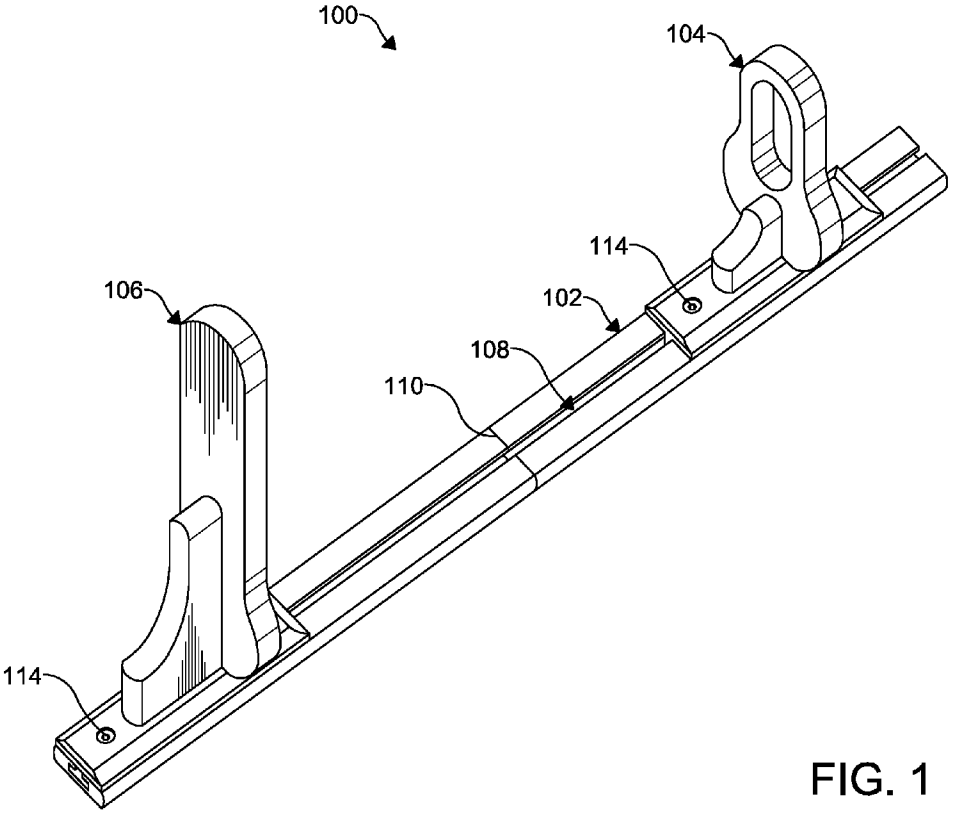
FIG. 1 is a right side perspective view of a wall mounting system according to one embodiment of the disclosure, the wall mounting system configured to hold a firearm such as a shotgun or a rifle in a substantially upright position on a wall surface.
Figure 2:
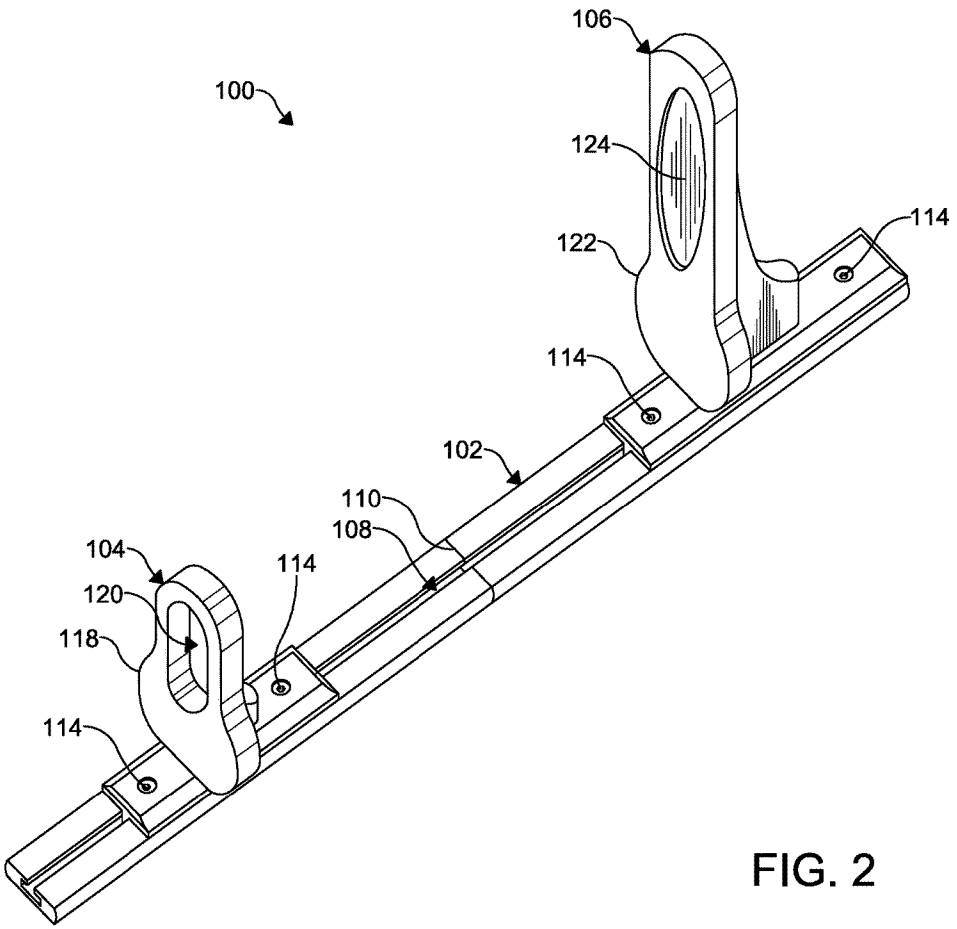
FIG. 2 is a left side perspective view of the wall mounting system shown in FIG. 1, and further showing a recess in a second holder to support a stock of gun in the second holder.

FIGS. 1-3 also shows that the fasteners 114 are accessible from a top or outer surface of the first holder 104. Being accessible from the outer surface, it should be understood that the fasteners 114 may be readily loosed or tightened in operation, in order to affix or move the first holder 104 along the length of the elongate main body 102, as desired.

With further reference to FIGS. 1-3, it should be appreciated that the second holder 106 of the present disclosure may be integrally formed with the elongate main body 102, or may also have the same features as described hereinabove with respect to the first holder 104. In the former instance, the second holder 106 is not movable relative to the elongate main body 102. In the latter instance, the second holder 106 is selectively movable relative to the elongate main body 102, and can be used together with the first holder 104 to accommodate a multitude of different accessory types and sizes. In certain embodiments, the second holder 106 has a platform 122, and a recess 124 located in the platform 122. The platform 122, may be oriented perpendicular to the elongate main body 102, and the recess 124 is configured to support the stock of a gun. However, the recess 124 may be sized appropriately to hold a variety of different types of accessories.

The second embodiment of the wall mounting system 200 is shown in FIGS. 8-12. Relative to FIGS. 1-7, like or related structure is identified in FIGS. 8-12 with a 200-series instead of a 100-series, for purpose of clarity.

Figure 9:
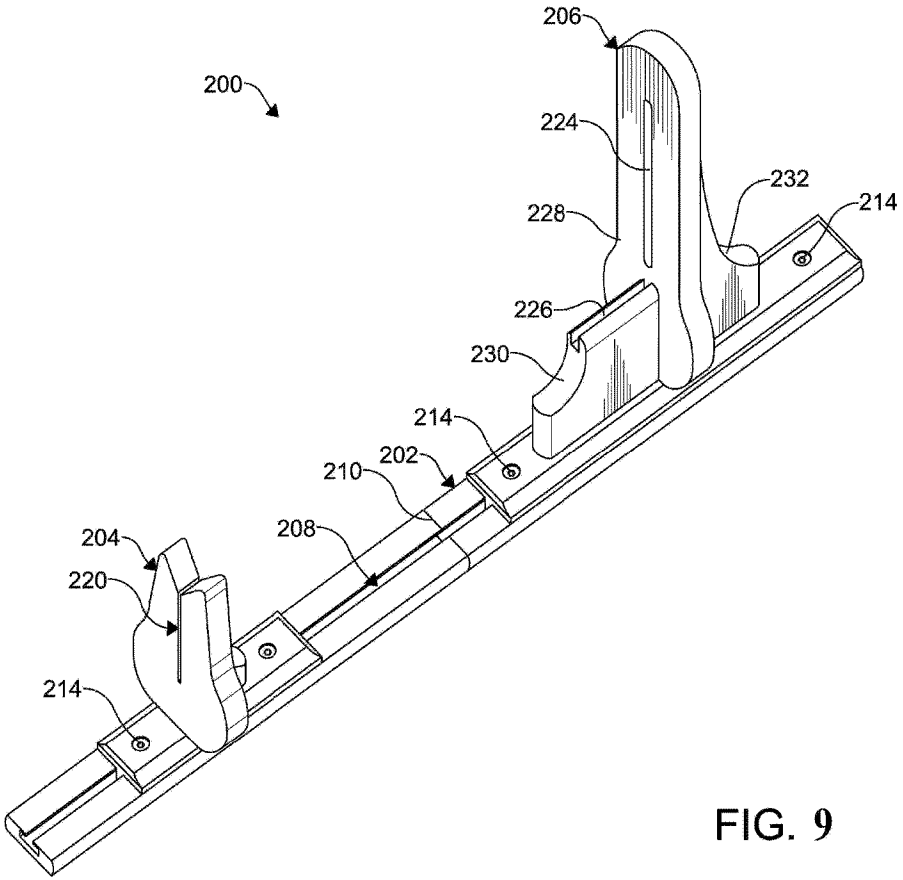
FIG. 9 is left side perspective view of the wall mounting system shown in FIG. 8.

As shown in FIGS. 8-9, the wall mounting system 200 is especially configured to hold an archery bow, such as a compound bow, a recurve bow, or a long bow. Each of the first holder 204 and the second holder 206 can be movable relative to the elongate main body 202, and can also be affixed to the elongate main body 202 with fastening means such as described hereinabove (for example, insert portions 215, fasteners 214, etc.). The elongate main body 202 may also be provided as a single unitary piece, or as a multi-piece assembly connected at a junction 210, as described hereinabove.

With respect to FIGS. 8-11, the first holder 204 of the wall mounting system 200 for archery bows may have a bow slot 220. The bow slot 220 is a thin channel configured to receive an archery bow string (not shown) of the bow, for example, to be held by the wall mounting system 200 in the substantially upright position.

In a particular embodiment, shown in FIG. 11, the bow slot 220 may have at least one spring-loaded ball bearing 222 disposed therein. For example, the bow slot 220 may have a pair of opposing spring-loaded ball bearings 222, each biased by an internal spring 223, and each disposed in a hole 225 formed on an inner surface of the bow slot 220. In operation, the opposing spring-loaded ball bearings 222 act to secure the bow string within the bow slot 220, until the archery bow is removed by a user from the wall mounting system 200 with a sufficient force to overcome the biasing of the internal springs 223.

Although a pair of spring-loaded ball bearings 222 are shown in FIG. 11, it should be appreciated that other features, such as nodules, bristles, teeth, detents, or the like, formed on the inner surface of the bow slot 220, may also be used to assist in the securing of the bow string within the bow slot 220, as desired.

With respect to FIGS. 8-9, it should be appreciated that the second holder 206 of the present disclosure may be integrally formed with the elongate main body 202, or may also have the same features as described hereinabove with respect to the first holder 204. In the former instance, the second holder 206 is not movable relative to the elongate main body 202. In the latter instance, the second holder 206 is selectively movable relative to the elongate main body 202, and can be used together with the first holder 204 to accommodate a multitude of different archery bow types and sizes.

Figure 10:
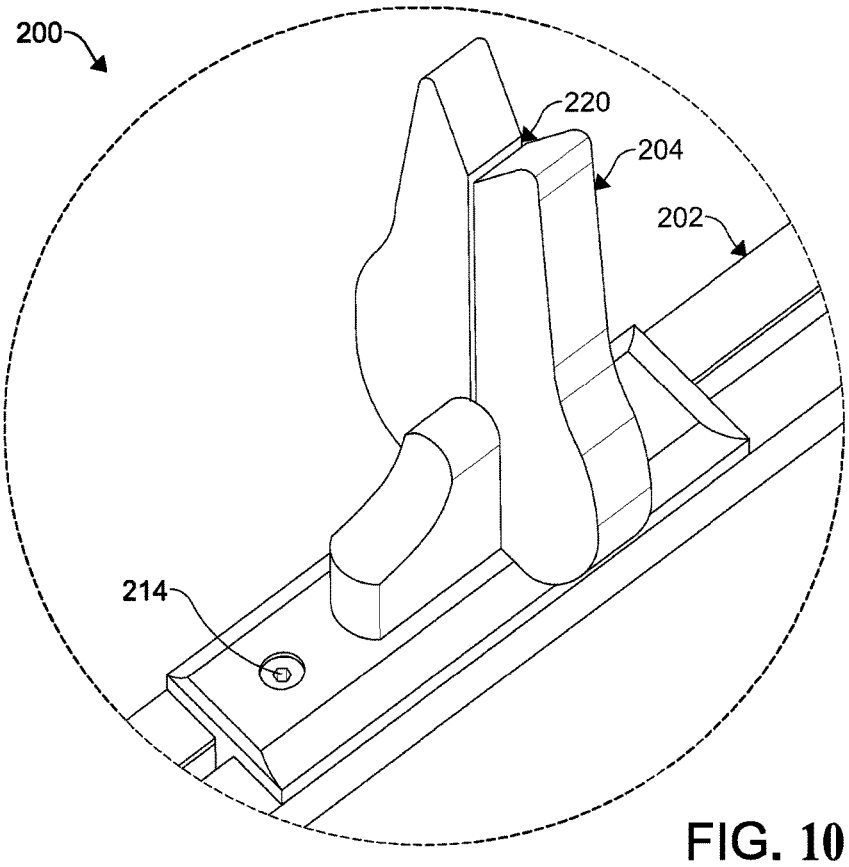
FIG. 10 is an enlarged fragmentary perspective view of the first holder taken at callout A in FIG. 8, further showing an archery bow slot formed in the first holder.

As shown in FIGS. 10 and 12, the second holder 206 may also have a first recess 224 and a second recess 226 formed therein. Each of the first recess 224 and the second recess 226 may be slots sized appropriately to accommodate a base of the bow, for example, a cam of a compound bow. Each of the first recess 224 and the second recess 226 may also be oriented along different and transverse planes, relative to one another, in order to support the bow from two different positions. In certain embodiments, the second holder 206 may have a first portion 228, a second portion 230 and a third portion 232. The first portion 228 may form a platform having the first recess 224 to support the base of the bow, while the second portion 230 may be oriented perpendicular to the platform and have a second recess 226 for receiving the bow string. The third portion 232 may act as a support to the first portion 228 and second portion 230, adding stability to the second holder 206. Other suitable shapes and orientation for the first recess 224 and the second 226 may also be used within the scope of the present disclosure, as desired.

One of ordinary skill in the art should appreciate that the wall mounting system 100, 200 described hereinabove may also be employed with other hunting accessories, such as fishing poles or rods, and non-hunting accessories, such as brooms, shovels, and other handled devices. Thus, although described hereinabove primarily with respect to shotguns, rifles, and archery bows, the wall mounting system 100, 200 of the present disclosure is not limited to any particular field of use or application.

While certain representative embodiments and details have been shown for purposes of illustrating the invention, it will be apparent to those skilled in the art that various changes may be made without departing from the scope of the disclosure, which is further described in the following appended claims.

What is claimed is:

1. A wall mounting system for an accessory including one of a firearm, an archery bow, and a fishing rod, comprising:

an elongate main body having a channel formed therein along a length of the elongate main body, wherein the elongate main body is configured for attachment to a wall surface;

a first holder having at least one insert portion coupled thereto with a fastener, wherein the insert portion of the first holder is selectively and slidably received in the channel of the elongate main body, wherein the first holder also has a rib configured to fit within the channel of the elongate main body, the at least one insert portion disposed through a gap in the rib; and a second holder coupled to the elongate main body, wherein the fastener of the first holder is adjustable to selectively affix the first holder along the length of the elongate main body, and the first holder is selectively movable along the length of the channel in the elongate main body relative to the second holder, and the first holder and the second holder are configured to together selectively secure the accessory to the elongate main body, and wherein the elongate main body is modular, and includes a selectively attachable first portion and second portion, the first portion having a first channel and the second portion having a second channel, the first portion of the elongate main body having an end with two male connectors, the first channel of the first portion disposed between the two male connectors, and the second portion of the elongate main body having an end with two female connectors, the second channel of the second portion disposed between the two female connectors, the male connectors and the female connectors configured to connect with one another to affix the first portion and the second portion to form the elongate main body with the first channel and the second channel together defining the channel of the elongate main body.

2. The wall mounting system of claim 1, wherein the insert portion has a grommet attached to a flat plate, the grommet and the flat plate configured to fit within the channel of the elongate main body.

3. The wall mounting system of claim 2, wherein the grommet is threaded and the fastener is one of a bolt and a screw, and the grommet is configured to attach to the first holder with the fastener.

4. The wall mounting system of claim 1, wherein the first holder has an aperture that is configured to receive a barrel of the gun.

5. The wall mounting system of claim 1, wherein the first holder has a bow slot to receive a bow string of the archery bow.

6. The wall mounting system of claim 1, wherein the second holder has a platform and a recess to support a stock of the gun.

7. The wall mounting system of claim 1, wherein the second holder has a first recess and a second recess configured to support a base of the archery bow.

8. The wall mounting system of claim 1, wherein the second holder also has at least one insert portion coupled thereto with a fastener, wherein the insert portion of the second holder is selectively slidably received in the channel of the elongate main body, the second holder also having a ridge configured to fit within the channel of the elongate main body, the at least one insert portion of the second holder disposed through the ridge of the second holder.

9. A wall mounting system for an archery bow, comprising:

an elongate main body having a channel formed therein along a length of the elongate main body, wherein the elongate main body is configured for attachment to a wall surface;

a first holder having at least one insert portion coupled thereto with a fastener, wherein the insert portion of the first holder is selectively and slidably received in the channel of the elongate main body, the first holder having a bow slot configured to receive a bow string, wherein the first holder also has a rib configured to fit within the channel of the elongate main body, the at least one insert portion disposed through a gap in the rib; and a second holder coupled to the elongate main body, and the second holder having a first recess and a second recess configured to support the base of the archery bow, wherein the fastener of the first holder is adjustable to selectively affix the first holder within the channel of the length of the elongate main body, and wherein the first holder is selectively movable along the length of the channel in the elongate main body relative to the second holder, and the first holder and the second holder are configured to together selectively secure the archery bow to the elongate main body, and wherein the elongate main body is modular, and includes a selectively attachable first portion and second portion, the first portion having a first channel and the second portion having a second channel, the first portion of the elongate main body having an end with two male connectors, the first channel of the first portion disposed between the two male connectors, and the second portion of the elongate main body having an end with two female connectors, the second channel of the second portion disposed between the two female connectors, the male connectors and the female connectors configured to connect with one another to affix the first portion and the second portion to form the elongate main body with the first channel and the second channel together defining the channel of the elongate main body.

10. The wall mounting system of claim 9, wherein the second holder also has at least one insert portion coupled thereto with a fastener, wherein the insert portion of the second holder is selectively slidably received in the channel of the elongate main body, the second holder also having a ridge configured to fit within the channel of the elongate main body, the at least one insert portion of the second holder disposed through the ridge of the second holder.

11. The wall mounting system of claim 9, wherein the first holder has a pair of bearings, each of the bearings movably affixed within one of a pair of holes that is in communication with the slot one of the bearings disposed on an opposite side of the slot relative to another of the bearings, and each bearing is supported by a spring also disposed one of the holes, the pair of bearings form a clamp in the slot to secure the bow string of the archery bow.

12. The wall mounting system of claim 9, wherein the second holder has a first portion a second portion, the first portion having the first recess and the second portion having the second recess, the first and second recess configured to support the base of the archery bow, the second portion oriented perpendicular to the first portion.

13. A wall mounting system for a gun, comprising:

an elongate main body having a channel formed therein along a length of the elongate main body, wherein the elongate main body is configured for attachment to a wall surface;

a first holder having at least one insert portion coupled thereto with a fastener, wherein the insert portion of the first holder is selectively and slidably received in the channel of the elongate main body, the first holder having an aperture configured to receive a barrel of the gun, wherein the first holder also has a rib configured to fit within the channel of the elongate main body, the at least one insert portion disposed through a gap in the rib; and a second holder coupled to the elongate main body, and the second holder having a recess configured to secure a stock of the gun, wherein the fastener of the first holder is adjustable to selectively affix the first holder within the channel of the length of the elongate main body, and wherein the first holder is selectively movable along the length of the channel in the elongate main body relative to the second holder, and the first holder and the holder are configured to together selectively secure the gun to the elongate main body, and wherein the elongate main body is modular, and includes a selectively attachable first portion and second portion, the first portion having a first channel and the second portion having a second channel, the first portion of the elongate main body having an end with two male connectors, the first channel of the first portion disposed between the two male connectors, and the second portion of the elongate main body having an end with two female connectors, the second channel of the second portion disposed between the two female connectors, the male connectors and the female connectors configured to connect with one another to affix the first portion and the second portion to form the elongate main body with the first channel and the second channel together defining the channel of the elongate main body.

14. The wall mounting system of claim 13, wherein the second holder also has at least one insert portion coupled thereto with a fastener, wherein the insert portion of the second holder is selectively slidably received in the channel of the elongate main body, the second holder also having a configured to fit within the channel of the elongate main body, the at least one insert portion of the second holder disposed through the of the second holder.

* * * * *